US005148734A

United States Patent [19]

Lilly

[11] Patent Number: 5,148,734

[45] Date of Patent: Sep. 22, 1992

[54] UNIVERSAL AIRCRAFT ROCKET/MISSILE LAUNCHER (UARML) AND TRIPLE LAUNCHER ADAPTER (TLA)

[75] Inventor: Eugene V. Lilly, Edwards AFB, Calif.

[73] Assignee: The United States of America as represented by the Secretary of the Air Force, Washington, D.C.

[21] Appl. No.: 687,357

[22] Filed: Apr. 18, 1991

[51] Int. Cl.[5] ..... F41F 3/04

[52] U.S. Cl. ..... 89/1.815; 89/1.819

[58] Field of Search ..... 89/1.815, 1.806, 1.819, 89/1.816

[56] References Cited

U.S. PATENT DOCUMENTS

| | | | |
|---|---|---|---|
| 2,451,745 | 10/1948 | Jolly | 89/1.815 |
| 2,709,947 | 6/1955 | Woods | 89/1.815 |
| 3,534,653 | 10/1970 | Specht et al. | 89/1.815 |
| 3,766,828 | 10/1973 | Cords | 89/1.8 |
| 3,771,412 | 11/1973 | Lebovitz | 89/1.807 |
| 4,412,475 | 11/1983 | Hornby | 89/1.816 |
| 4,423,661 | 1/1984 | Sheldon | 89/1.819 |
| 4,637,292 | 1/1987 | Peterson | 89/1.815 |
| 4,660,456 | 4/1987 | Griffin et al. | 89/1.819 |
| 4,681,013 | 7/1987 | Farley et al. | 89/1.815 |
| 4,685,377 | 8/1987 | Mace et al. | 89/1.815 |
| 4,711,151 | 12/1987 | Griffin et al. | 89/1.815 |
| 4,736,669 | 4/1988 | Long et al. | 89/1.819 |
| 4,785,710 | 11/1988 | Schofield | 89/1.815 |
| 4,911,059 | 3/1990 | Brueckner | 89/1.806 |

*Primary Examiner*—David H. Brown

*Attorney, Agent, or Firm*—William G. Auton; Donald J. Singer

[57] ABSTRACT

A missile launcher system for use on fixed and rotary wing aircraft to carry, arm and launch missiles and rockets. The apparatus includes a retention unit a support beam, a positive stop, an electrical interface, and a triple launcher adapter with adjustable support arms. The triple launcher adapter (TLA) is designed to accommodate three different sizes of rockets or missiles at one time. The adjustable support arms of the TLA can be unbolted and moved in or out to compensate for the various rocket and missile sizes and shapes.

1 Claim, 6 Drawing Sheets

UNIVERSAL AIRCRAFT ROCKET/MISSILE LAUNCHER (UARML) AND TRIPLE LAUNCHER ADAPTER (TLA)

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to aircraft, and more specifically the invention pertains to a standardized method by which all Air Intercept Missiles (AIM), Air to Ground Missiles (AGM) and rockets can be carried and launched from all current and future fighter, attack and intercept fixed and rotary wing aircraft. The Triple Launcher Adapter (TLA) used in conjunction with the UARML provides for adjustable intermixable missile/rocket loads, and is usable by all current and future fighter, attack and intercept fixed and rotary wing aircraft.

Missiles are generally not mounted directly to an aircraft, but rather are mounted to launchers which are fixed to the aircraft. In this manner, the missile can be launched from the launcher, while the launcher remains fixed to the aircraft. Conventional missile launchers include a rail structure for holding a missile, and electromechanical apparatus for fixing the missile to the launcher during aircraft take-offs and landings. A release mechanism arms the missile and releases it for launching. Power supply equipment is also housed within the launcher for controlling the fusing and firing of the missile, and in the heat seeking type of missiles, equipment for interconnecting a source of compressed nitrogen to the missile for an infrared detector.

Missiles are generally adapted for launching from different types of aircraft, and thus the associated launcher must be adapted to fit many types of aircraft. Aircraft bomb racks and pylons are typical of structures for attachment of missile apparatus to the aircraft. Military aircraft bomb racks have hooks with mounting centers typically of fourteen inches or thirty inches. Aircraft pylon mounting structures comprise studs or threaded holes which are spaced apart about thirty inches. In the case of Sidewinder missiles, adapters have been provided for mounting a missile launcher to the bomb racks.

Currently, all Air Intercept Missiles and Air to Ground Missiles have complicated and unique launcher mechanism which are characterized as having complicated mechanical spring retention components, shear pins and other devices used in the jettison sequence. The task of providing a simplified, uniform launcher system is alleviated, to some extent, by the systems disclosed in the following U.S. Patents, the disclosures of which are specifically incorporated herein by reference: U.S. Pat. No. 4,736,669 issued to Long et al.; U.S. Pat. No. 4,660,456 issued to Griffin, et al.; U.S. Pat. No. 4,423,661 issued to Sheldon; U.S. Pat. No. 3,771,412 issued to Lebovitz; and U.S. Pat. No. 3,766,828 issued to Cords.

The patents identified above relate to airborne missile or rocket launcher apparatus. In particular, the Long et al patent describes a missile launcher which can be mounted to different types of aircraft without an adapter. The body of the missile launcher is formed with an elongated top planar surface to provide rigidity to the launcher. Threaded holes are spaced apart in the planar surface for receiving threaded suspension lugs which are fixed to the bomb racks or pylon mountings on an aircraft. Sway braces can be positioned along the platform to prevent wobble or angular movement of the launcher. The sway braces can be moved to any longitudinal position along the launcher body to accommodate the positional constraints of different aircraft equipment.

The Griffin et al patent relates to an airborne missile launcher of modular construction capable of carrying a variety of different missiles. The main body section of the launcher has top attachment points for attachment to an aircraft, and sub-rail hangers on the underside to receive a variety of missile carrying sub-rails. Each sub-rail has one or more longitudinal tracks for carrying a particular type of missile. Forward and aft body sections are selected to suit the different types of missiles, and are attached to the main body section.

The Sheldon patent describes an airborne missile rail launcher with an improved loading and unloading mechanism. The launcher includes movable sections along the length of the rail. Each section is actuable to form a gap in an otherwise continuous rail. The sections are arranged to allow the lugs on a missile to be positioned without having to slide the missile along the rail. Positioning the missile causes the movable section to form a substantially continuous rail on which the missile is held until launching or unloading is desired.

The Lebovitz patent relates to an apparatus for securing a missile to an aircraft, and firing the missile when desired. The apparatus comprises a locking arrangement, ejector means, firing system, energizing means, and stray energy monitors. The launcher is powered by two electrically initiated cartridges which act in conjunction with a pair of twin telescoping pistons to eject the missile. The launcher energizing means is a gas system comprising cartridges mounted in the launcher breech. The missile is secured to the launcher by launch hooks which attach to the existing missile lugs. Positive lock of the launch hooks is accomplished by a solenoid actuated bell crank which locks the hook release. When arming occurs, the energized solenoid unlocks the hook linkage. An umbilical type plug provides missile motor control, and energizes the missile. After launch, the plug disconnects and returns to its position within the launcher. Finally, a stray energy detection system insures quick and safe loading of cartridges and missiles.

The Cords patent describes an aircraft missile launching apparatus which comprises a launching module with a central beam and a missile launcher on either side of the beam. The beam is attached to the normal aircraft bomb racks through mounts on the upper end of the beam. Each launcher includes a bulk head at the front end, a debris tube at the aft end, and a gate in the center. The gate receives and secures the missile to the launcher. To initiate the firing sequence, an arming handle sequentially moves a shear pin in the container to free the missile for launch. The handle also attaches an electrical connector to the missile container. Although these patents relate to aircraft missile or rocket launchers, they do not describe a launcher with a one piece support beam and a triple launcher adapter having adjustable support arms to accommodate the variety of rockets and missiles.

SUMMARY OF THE INVENTION

The present invention includes a Universal Aircraft Rocket/Missile Launcher (UARML) and Triple Launcher Adapter (TLA).

This system can be used on fixed or rotary wing aircraft to carry, arm and launch missiles and rockets. The apparatus comprises a retention unit, a support beam, a positive stop, an electrical interface, and a triple launcher adapter with adjustable support arms. The mechanical portion of the retention unit includes a positive locking device which is a block that fits in front of one of the missile mounting lugs. The retention unit has no electrical connection with the missile, but relies on a purely mechanical contact with installed missiles. A safety lock prevents inadvertent removal of the locking block. Three microswitches provide an electrical safety feature by insuring the proper sequential operation of the retention unit. The support beam which is one piece construction, is attached to the rail, and has specially designed recesses for the mounting screws. The aerodynamically shaped positive stop is attached to the aft lower end of the rail, and is of sufficient size and strength to retain any rocket or missile. The electrical interface provides for all guidance and control, arming and firing signals from the aircraft and launcher to the installed missile or rocket.

The interface is attached to the aft end of the launcher and installed missile or rocket. The interface varies in size and shape to accommodate the installed missile or rocket. The contact area of the interface is a recessed "V" with a row of contacts down each interior side of the "V" which meet with a matching set of contacts on the aft end of the installed missile or rocket. A guide is incorporated to ensure proper contact alignment. A raised bevel or bead on the interior top end of the interface "V" provides for a mosture tight seal with installed missile/rockets and insures continuous contact is maintained. The triple launcher adapter (TLA) is designed to accommodate three different types, styles and sizes of rockets or missiles at one time. The adjustable support arms of the TLA can be unbolted and moved in or out to compensate for the various rocket and missile sizes and shapes.

It is an object of the present invention to provide a simplified missile/rocket launching system for aircraft with a reduced number of moving parts and a reduced number of total parts.

It is another object of the present invention to provide a universal missile/rocket launching mechanism for aircraft with adjustable support arms that can be moved to compensate for various missile/rocket sizes and shapes.

These together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a universal rocket/-missile launching system which can be used on fixed or rotary wing aircraft to carry, arm and launch missiles and rockets. The apparatus comprises a retention unit, a support beam, a positive stop, an electrical interface, and a triple launcher adapter with adjustable support arms.

Figure 1:
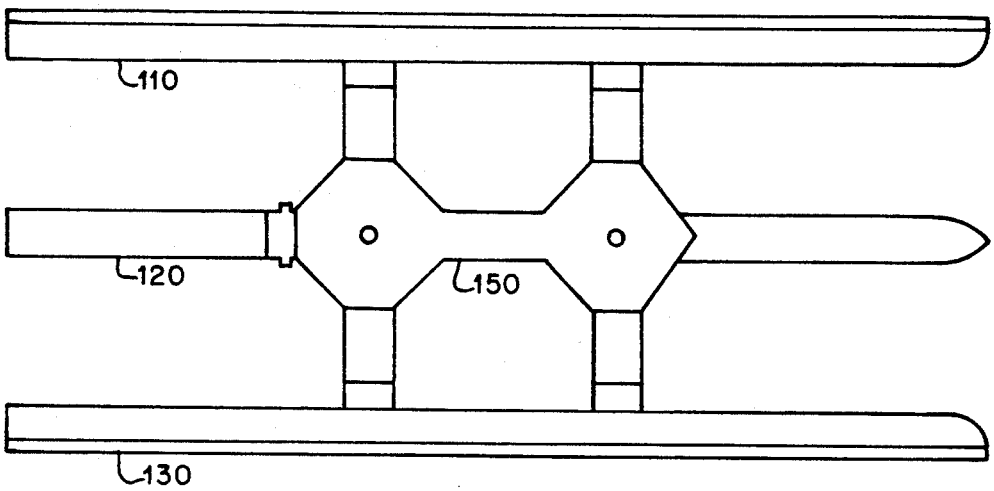
FIG. 1 is a plain view of a triple launcher adapter with three universal aircraft rocket/missile launchers (UARML) attached.
Figure 2:
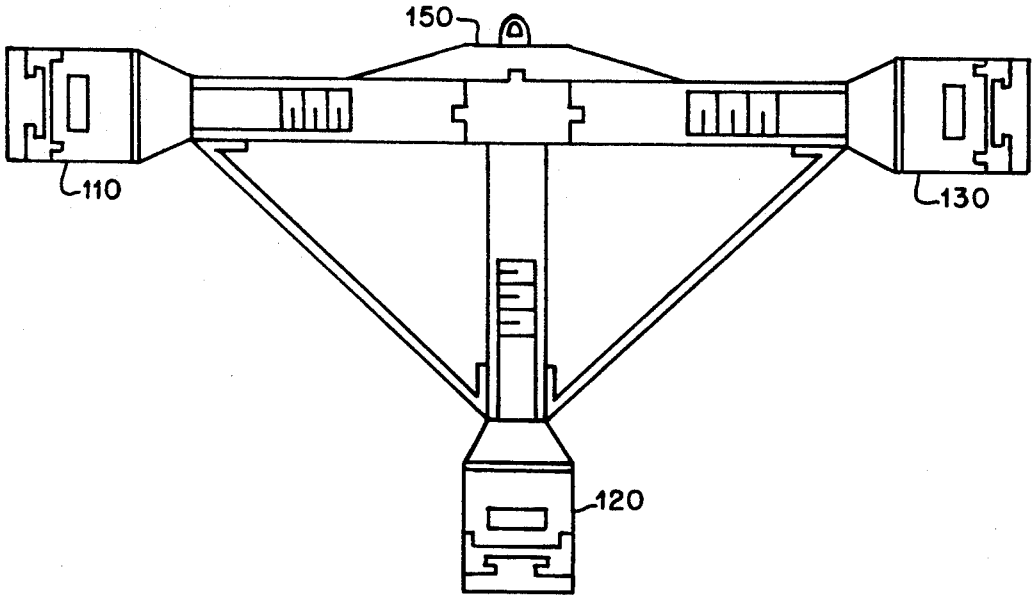
FIG. 2 is an end view of the system of FIG. 1.
Figure 3:
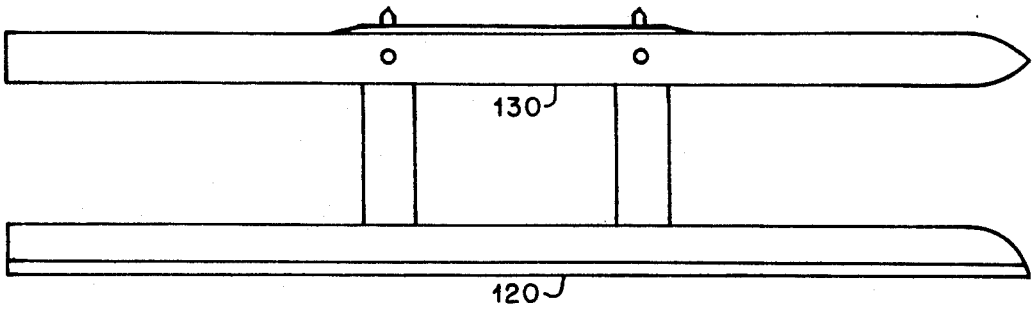
FIG. 3 is a side view of the system of FIG. 1.

In order to understand the preferred application the reader's attention is now directed towards FIGS. 1–3 which are illustrations of three UARML's (110, 120, and 130) attached to one TLA from three different views. FIG. 1 is a plain view of the system, FIG. 2 is a rear view of the system, and FIG. 3 is a side view of the system.

The triple launch adapter 150 adjustably holds each of the three UARML's (110, 120, and 130) at adjustable distances from the aircraft. Each UARML is a mechanical airborne missile launcher similar that of the above-cited Long et al. and Griffin et al. patents. This indicates that the system of FIGS. 1–3 is used to retain and hold up to three missiles next to the body of an aircraft at adjustable distances. As will be discussed below, this is possible due to the use of adjustable launcher mounts in the triple launch adapter which may be extended and retracted to vary the distance at which the missiles are held next to the aircraft. The details of the triple launcher adapter are discussed below.

Figure 4A:
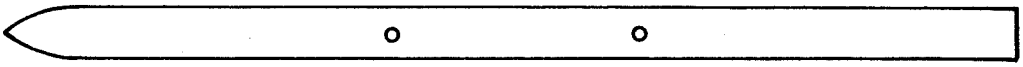
FIGS. 4A–4C respectively depict a bottom, side and end view of a UARML.
Figure 4B:
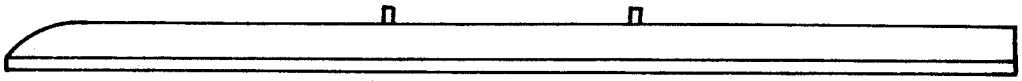
Figure 4C:
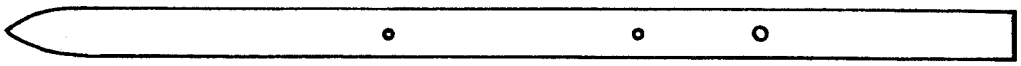
Figure 5:
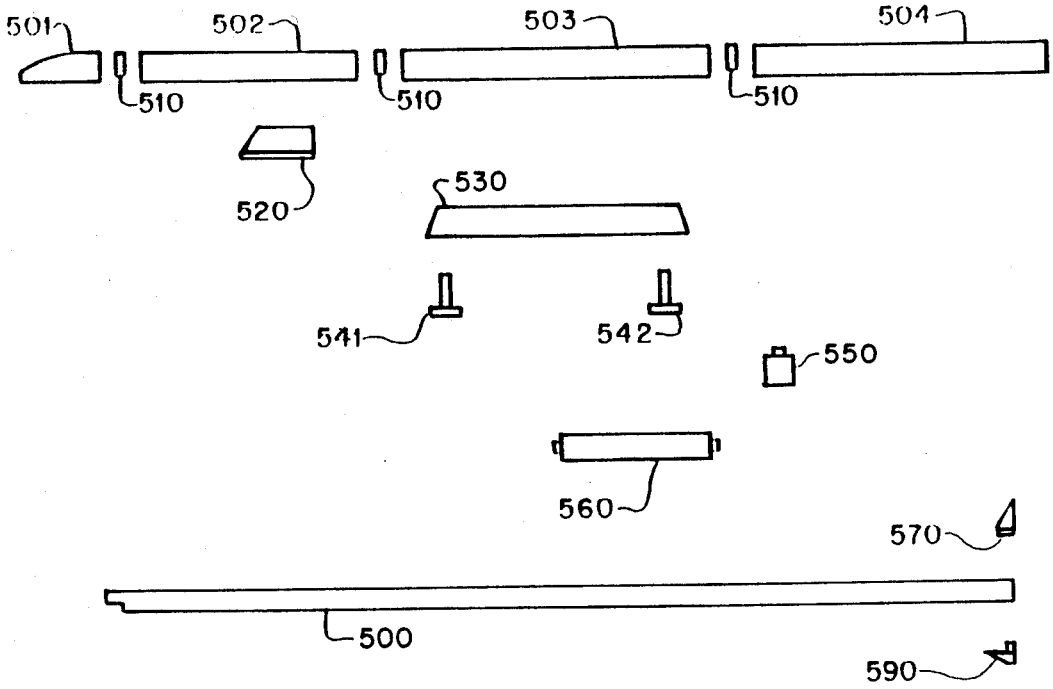
FIG. 5 is an exploded view of a UARML which shows the individual mechanical components.

FIGS. 4A, 4B and 4C respectively depict a bottom, side and top view of one of the UARML units of FIG. 1. FIG. 5 is an exploded side view of the UARML unit of FIG. 4B.

The system of FIG. 5 includes: a rail 500, a nose cover 501, a forward cover 502, a mid cover 503, an aft cover 504, three joint brace units 510, a retention unit 520, a support beam 530, two mount screws 541 and 542, a feedthru 550, a logic center 560, an attachment block 570, and a positive stop 590. The functions of each of these elements are described below.

In the system of FIGS. 5, each missile is held and released by the combined interrelationship between the rail 500, the positive stop 590, and the retention unit as described below. Note that the nose cover 501, the forward cover 502, the mid cover 503 and aft cover 504 are elements which are not released with the missile, but act as a protective cover for the internal components of the UARML. More specifically, they cover: the retention unit 520, the support beam 530, the logic center 560, the feed thru 550 ,and holds the two mount screws 541 and 542 in place. The cover units 501-504 also provide structural strength for the complete unit.

The retention unit 520 provides a positive mechanical means for missile/rocket restraint until time of launch or unloading. It also incorporates positive electrical firing circuit interrupt until time of launch when motor fire circuits are completed.

In FIG. 5, the support beam 530 is used to support the rail 500 and provide a means of attachment to either the TLA or an aircraft.

The rail 500 is where the missile/rocket is carried by means of "t" style hangers. The retention unit, covers, support beam, feedthru, logic center, positive stop, and interfaces attachment block are all attached to the rail.

The positive stop 590 prevents missiles/rockets from being slid of the aft end of the UARML during loading, unloading, and flight.

The logic center 560 identifies the type missile/rocket installed and provides selection match data to the aircraft. It also provides guidance and control for the selected installed missile, and provides arming/disarming of the selected installed missile/rocket. Logic center 560 also provides installed missile/rocket status to the aircraft.

The attachment block 570 is where the missile/rocket interface is attached and the means by which all signals are passed from the aircraft to the installed missile/-rocket or from the missile/rocket to the aircraft.

The feedthru 550 is where the UARML is externally attached electrically to the TLA or aircraft by use of quick disconnect electrical connector and internally to the logic center also by quick disconnect electrical connector.

Figure 6:
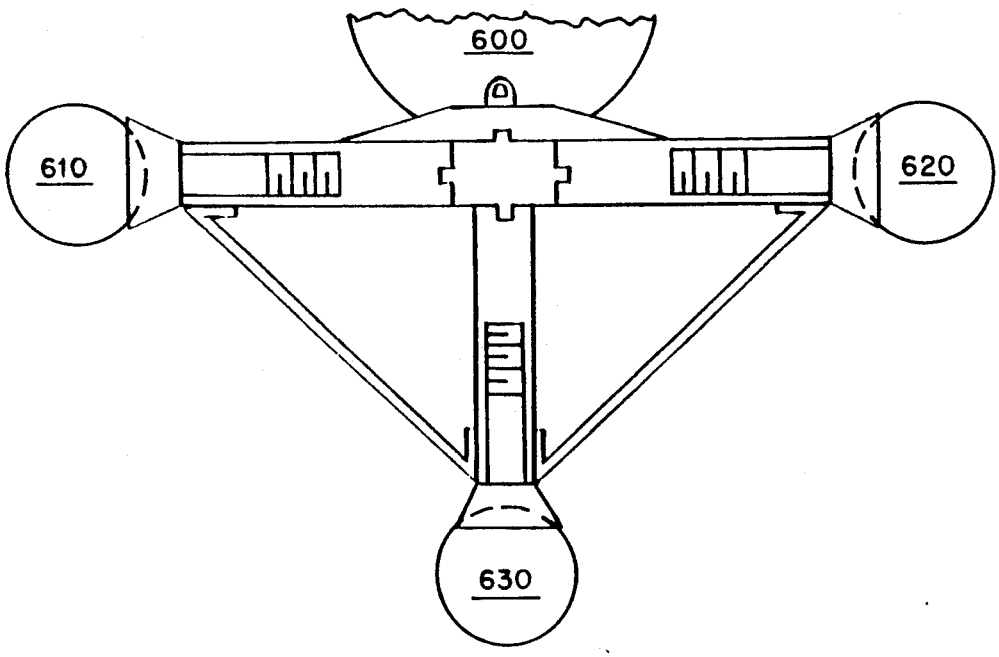
FIG. 6 is an end view of the triple launcher adapter of FIG. 1.
Figure 7:
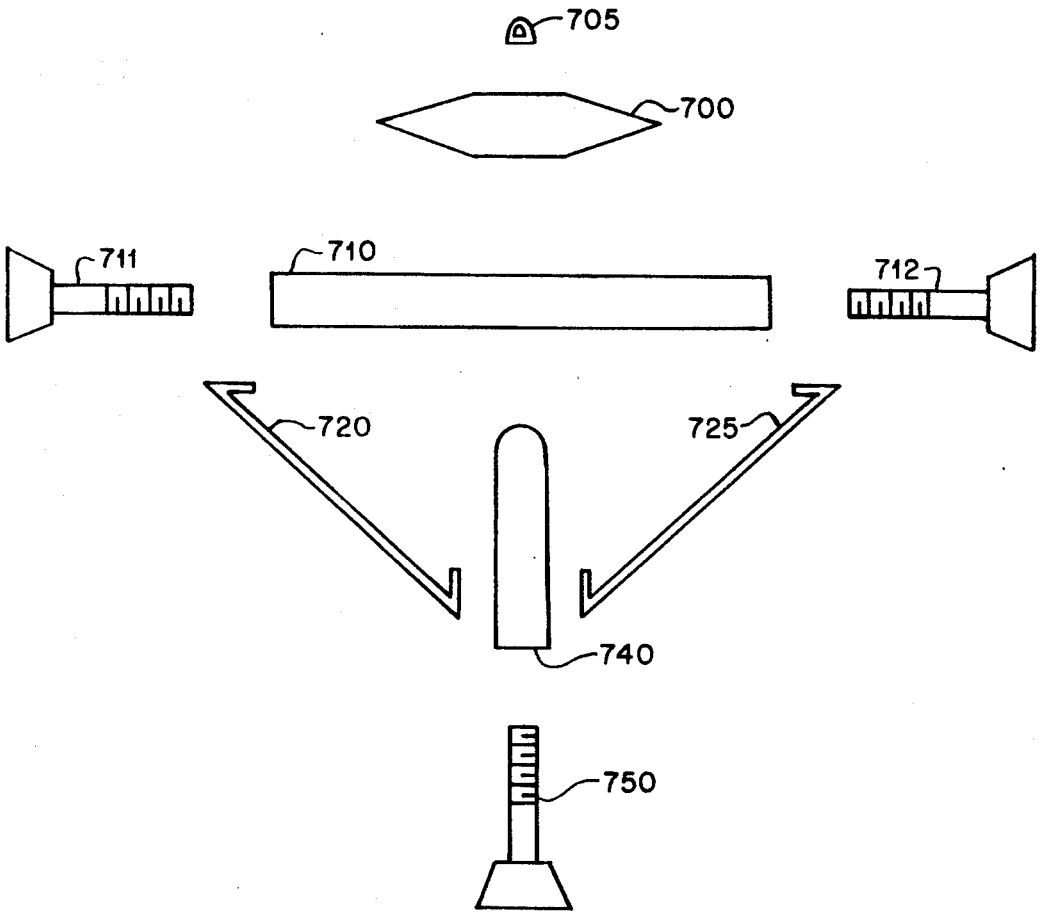
FIG. 7 is an exploded view of the triple launcher adapter of FIG. 6.

FIG. 6 is a view which looks forward towards a triple launcher adapter (TLA) which has adjustable support arms. FIG. 7 is an exploded view of the section of FIG. 6. In the system of FIG. 7, the TLA provides adjustable mounting positions for three UARMLs as well as required electrical interconnect from the aircraft 600 to the UARML. The elements of the TLA include: a main support beam 700, a main support arm 710 two diagonal support braces, and adjustable launcher mounts 711, 712 and 750. Each of these elements are discussed below.

The main support beam 700 is where the TLA is attached to the aircraft and provides a mounting surface for the main support arms and lower support arms 740. It is also where the TLA logic center is attached.

The main support arm 710 provides the housing and means for adjustment for two launcher mounts 711 and 712.

The diagonal support braces 720 and 725 are used to provide stability and strength between the main support arm 710 and the lower support arms 740.

The launcher mounts 711, 712 and 750 each provide the place where the UARML is attached mechanically to the TLA and provides the means by which the TLA may be adjusted to accommodate various sized and weighted missiles/rockets 610, 620 and 630.

The three launcher mounts are said to be adjustable, since they may protrude at variable distances from their respective support arms 710 and 740. As shown in FIG. 7, each adjustable launcher mount has a cap and a long shaft which protrudes into the support arm. This shaft is mechanically attachable to its respective support arm such that it may be extended and retracted as needed to vary the distance that a missile is held from the aircraft.

There are a variety of mechanical alternatives by which the launcher mounts may be adjustably fixed with variable distances to their respective support arms. The long shafts of the launcher mounts may be threaded so that they screw into the support arms 710 and 740 with variable distances between their caps and the end of the support arms. The adjustable launcher mounts 711, 712 and 750 may also have a plurality of holes which allow it to be bolted to the support arms 710 and 740 with variable distances. This use of adjustable launcher mounts has a number of advantages over the above-cited prior art systems. These advantages are discussed below.

As mentioned above, a variety of air intercept missiles are currently in use. These different missile systems have different diameters which make it necessary to fix them t variable distances from aircraft. Conventional launchers do not allow distances between the missile and the aircraft to be varied, with the result that the launcher system on a specific aircraft often will have to be replaced entirely when the missile is changed. An adjustable launcher eliminates this problem.

Figure 8A:
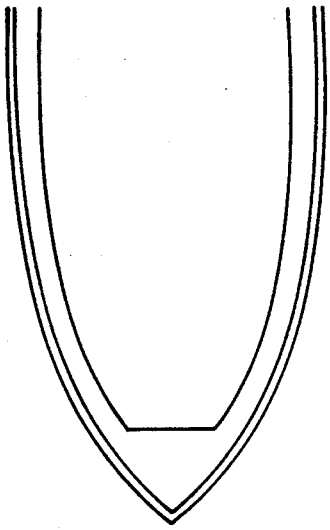
FIGS. 8A–8C respectively depict a top view, a side view and an end view of the UARML end rail.
Figure 8B:
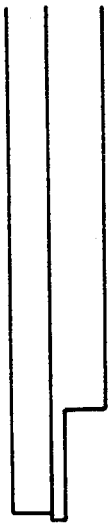
Figure 8C:
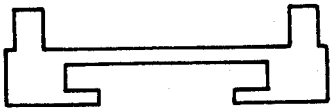

FIG. 8 is a mechanical schematic of a side view, top view and end view of the UARML rail 500 of FIG. 5. The end view illustrates the "T" style hangers which are used in the conventional manner to carry the missile until it is released.

Figure 9:
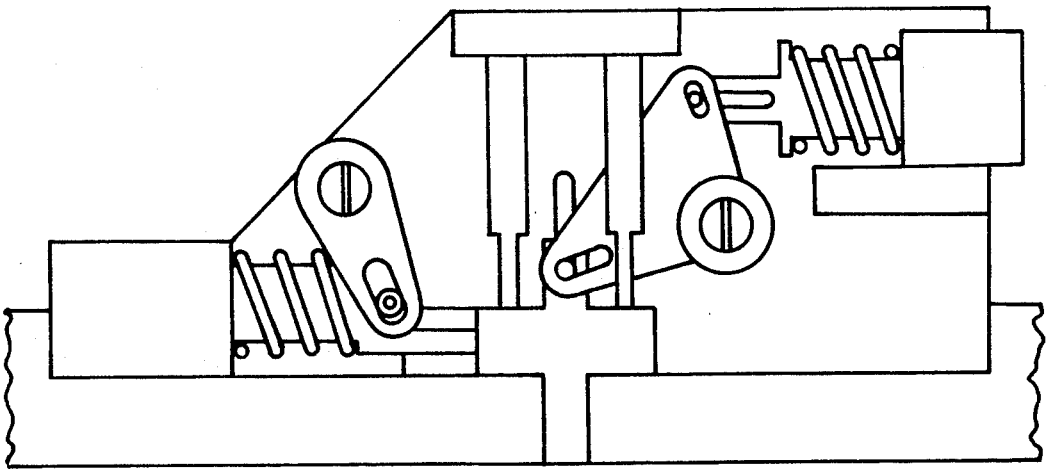
FIG. 9 is a side view of the retention 5.

FIG. 9 is a side view of the retention unit which is used as element 520 in the UARML of FIG. 5. As mentioned above, the retention unit is the portion of the UARML which provides a positive mechanical restraint of the missile until launch or unloading. The retention unit is best understood by viewing FIG. 10, which is an exploded side view of the unit of FIG. 9.

Figure 10:
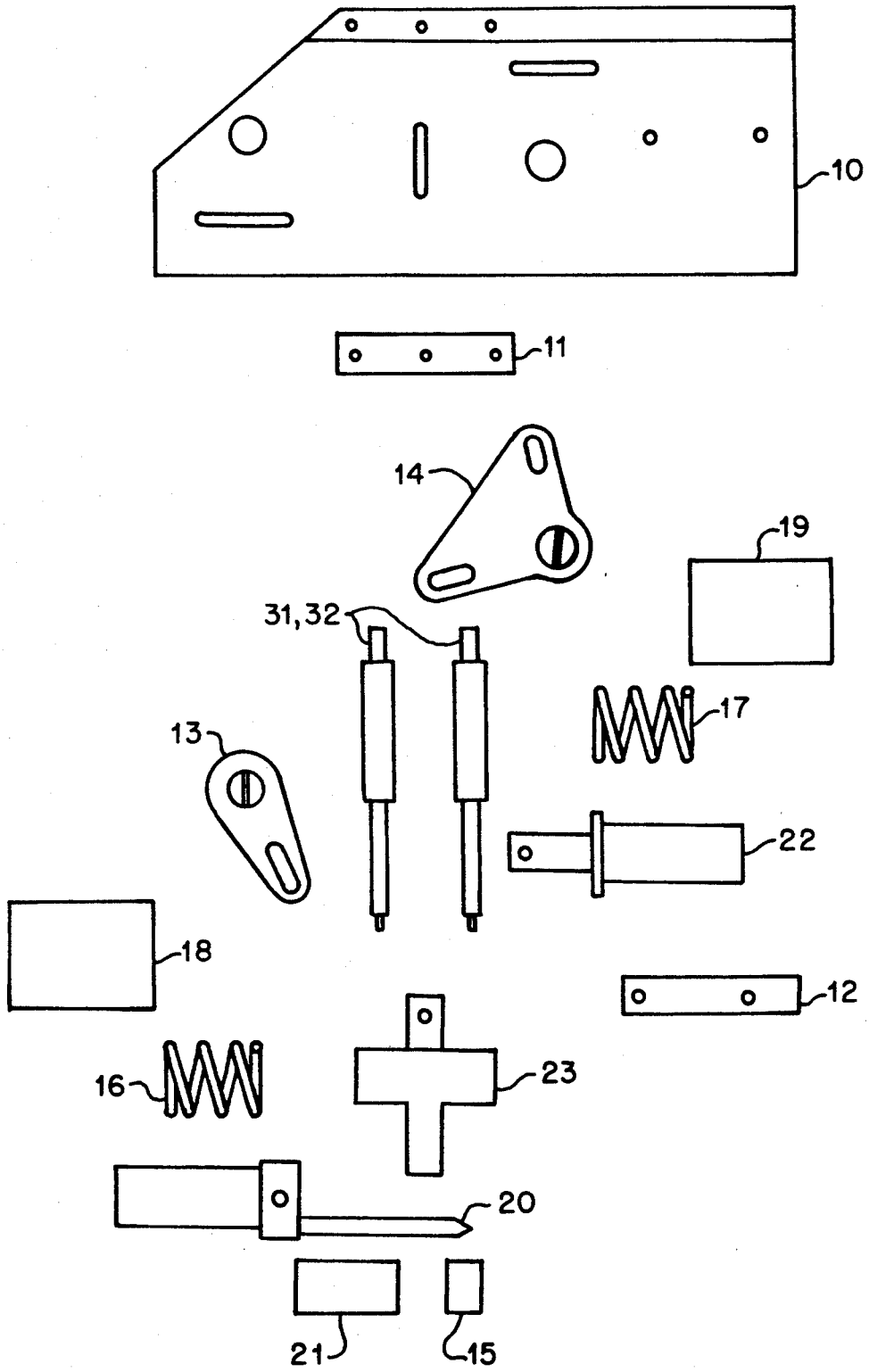
FIG. 10 is an exploded view of the retention unit of FIG. 9.

The elements of FIG. 10 include: a set of housing plates 10, a guide pin retainer 11, an unlock solenoid platform 12, a safety lock pivot arm 13, a locking block pivot arm 14, a safety lock brace 15, a safety lock return spring 16, a locking block return spring 17 a safety lock solenoid 18, a locking block solenoid 18, a safety lock plunger and in 20, a safety lock guide 21, the unlock plunger 22, the locking block 23, four guide pins 31 and 32 and the locking block pivot arm 14.

The housing plates 10 house the working components of the retention unit. They are attached to the rail by use of number 2 phillip contersunk screws. The housing plates 10 provide the mounting platform for the guide pin retainer 11 and the unlock solenoid platform 12. These are attached to the housing plates 10 by use of a number 2 phillip countersunk screws. The housing plates 10 also provide the pivot points for the safety lock pivot arm 13 and the locking block pivot arm 14. The housing plates 10 also contain the pivot pin guide slots for the locking block pivot arm 14 and the safety block pivot arm 13. Two pivot pins are used to connect the unlock solenoid to the lock block 23 via the locking block pivot arm 14. The safety lock pivot arm 13 is attached to the safety lock via a pivot pin. Each pivot arm 13 and 14 is equipped with slots at each end. These slots are used for manual operations during loading and unloading. There are four guide pins (two each 31 and 2 each 32) for the locking block 23. These are to insure smooth operation of the locking block 23 and prevent binding. The safety lock, when engaged, passes through the safety lock guide 21, the locking block 23, and the safety lock brace 15.

The present invention has a built in mechanical safety feature in the form of a safety lock 20. This safety lock must be withdrawn from the locking block 23 during both the lock and unlock sequences of the launcher. In the locked position the locking block is extended through the rail and is in front of an installed missile's mount. The safety lock 20 is then inserted into the locking block 23 to prevent the locking block from being accidentally removed prior to the need to launce a missile. During the unlock sequence, the safety lock must be withdrawn from the locking block prior to the retraction of the locking block 23 into the rail. Then the safety lock is reinserted into the locking block to prevent accidental reinsertion in front of the missile mount during the launch sequence.

The safety lock guide 21 and brace 15 are attached to rail by number 2 phillip countersunk screws. The safety lock is used to prevent the accidental unlocking of the UARML with an installed missile/rocket. The safety lock brace 15 insures the safety lock is not bound by bending if an unlock is attempted with the safety pin in the locked position. The safety lock also prevents the locking block 23 from being inadvertently placed in the locked position during the firing and/or jettison sequences. The locking block and safety lock return springs 16 and 17 are used to return the solenoid plungers to the normally deenergized positions during various phases of UARML operations. The return springs ensure that the maximum amount of safety is achieved. These springs insure that the safety pin is always engaged in the locking block, either in the safe or fire positions. To unlock a missile requires a deliberate act.

Incorprated in the retention unit are three microswitches used for the sequential operation of the retention unit during normal and emergency jettison procedures. No external safety devices are required to prevent accidental/inadvertent launch or jettison of rocket or missile. This is accomplished by use of the microswitches in the retention unit. The locking block MUST be in the unlocked position to close the circuit necessary to supply firing voltage to the missile/rocket motor.

Current aircraft missile launchers have either an adjustable spring pressure missile retention device with missile motor fire contacts incorporated; or a shear pin retention method. There are a number of drawbacks to the use of these methods of missile retention.

The spring pressure retention units requires the accomplishement of a check on a 60 day cycle to verify that the retention force necessary to retain installed units has not gotten out of tolerance. If the force readings are out of tolerance the launcher must be removed from the aircraft, and then disassembled to allow access to the adjustment mechanisms.

If the pressure is too weak, the installed missile may slide forward off the aluncher upon aircraft landing. The missile motor fire contact may not be correctly or fully seated, which could prevent missile launch, or cause an inadvertent launch. If the pressure is too great, the installed missile could not leave the launcher upon motor fire and could leave a live, active and armed missile on the aircraft.

Launchers with the spring pressure retention type units require specialized tools and test equipment to support the designed operational and maintenance requirements of the launchers. Launchers that use shear pin retention devices have a drawback in that the shear pins can be broken by any number of methods.

The UARML eleminates the umbilical connector and the mechanical brake away umbilical block retention device. It also does away with the mechanical umbilical extraction device. All missile electrical connections occur through the interface. This item is attached to the aft end of the UARML and the installed missiles. The motor fire contacts of the current launcher spring pressure retention units are incorporated into the interface also and not a separate circuit located elsewhere in the launcher.

The UARML provides a standard missile launcher usable on all aircraft. It is simple in design, construction, and operation. It uses one type, style, and size of common hardware in the assembly process. There is no requirement to periodically inspect or test the retention unit as the devices which require reoccurring testing and adjustment have been eliminated. Electrical connection between the launchers have been reduced to one easily accessible point. Safety margins have been increased by keeping the missile motor fire circuit open until just prior to lanch when the missile is unlocked.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A universal aircraft missile launcher system for holding a missile next to the body of an aircraft, said universal aircraft missile launcher system comprising:

a means for mechanically retaining missiles, said retaining means mechanically retaining the missile next to the body of the aircraft;

a main support arm which serves as a frame; and which is fixed to said retaining means;

a main support beam which is fixed to said support arm;

a suspension lug which fixes said main support beam to said aircraft; and a shaft which is fixed to said retaining means and which can protrude into said main support arm at adjustable depths so that said retaining means may be fixed at variable distances from said main support arm, wherein said shaft is threaded so that it screws into said main support arm so that the retaining means may be fixed at said variable distance from said main support arm.

* * * * *